US006056073A

United States Patent [19]

Boulet

[11] Patent Number: 6,056,073

[45] Date of Patent: May 2, 2000

[54] ELEMENT OF A ROTATING DRILL PIPE STRING

[75] Inventor: Jean Gilbert Boulet, Paris, France

[73] Assignee: S.M.F. International, Cosne Sur Loire, France

[21] Appl. No.: 09/039,338

[22] Filed: Mar. 16, 1998

[30] Foreign Application Priority Data

Mar. 17, 1997 [FR] France ..... 97 03207

[51] Int. Cl.[7] ..... E21B 17/22

[52] U.S. Cl. ..... 175/323; 175/325.1

[58] Field of Search ..... 175/323, 61, 65, 175/324, 325.1, 325.5; 166/241.1

[56] References Cited

U.S. PATENT DOCUMENTS

| | | | |
|---|---|---|---|
| 3,085,639 | 4/1963 | Fitch . | |
| 3,338,069 | 8/1967 | Ortloff . | |
| 3,749,189 | 7/1973 | Boehm | 175/394 |
| 4,210,215 | 7/1980 | Peetz et al. | 175/394 |
| 4,285,407 | 8/1981 | Samford . | |
| 4,854,399 | 8/1989 | Zijsling | 175/61 |
| 4,874,045 | 10/1989 | Clayton . | |
| 4,949,797 | 8/1990 | Isom . | |
| 4,995,466 | 2/1991 | Snow, Jr. . | |
| 5,040,620 | 8/1991 | Nunley . | |
| 5,937,957 | 8/1999 | Swietlik | 175/323 |

FOREIGN PATENT DOCUMENTS 2517357 6/1983 France .

*Primary Examiner*—Frank Tsay
*Attorney, Agent, or Firm*—Sughrue, Mion, Zinn Macpeak & Seas, PLLC

[57] ABSTRACT

A rotating drill pipe string element (1) includes at least one portion (2*a*) of tubular shape whose external surface has at least one groove (8*a*, 8*b*, 8*c*, 8*d*, 8*e*) arranged in a helix having as an axis the axis (O) of the tubular portion (2*a*). The groove (8*a*, 8*b*, 8*c*, 8*d*, 8*e*) has a cross-section in a plane perpendicular to the axis (O) of the portion having an undercut part (10) lying to the rear of a radius (OA) of the cross-section of the tubular portion, (2*a*), the radius passing through the external end (A) of the area of the groove (8*c*) lying to the rear, with respect to the forward direction of rotation of the pipe string of the groove (8*c*) with respect to the forward direction of rotation (Ω) of the pipe string.

15 Claims, 4 Drawing Sheets

ELEMENT OF A ROTATING DRILL PIPE STRING

BACKGROUND OF THE INVENTION

The present invention relates to an element of a rotating drill pipe string.

In the field of exploration and working of petroleum deposits, rotating drill pipe strings are used, these consisting of pipes and other tubular elements which are joined together, end to end, according to the drilling requirements.

Such pipe strings may allow, in particular, sidetracked holes to be produced, i.e. holes whose inclination with respect to the vertical or the azimuth direction may be varied, during drilling.

In the case of highly offset sidetracked holes having horizontal or almost horizontal portions, the friction torques due to the rotation of the drill string may reach very high values during drilling. The friction torques may bring into question the equipment used and/or the drilling objectives. Furthermore, it is often very difficult to bring up the cuttings produced by the drilling, on account of the sedimentation of the debris produced in the drill hole, in the bottom part of the drill hole near the drill bit. This results in poor cleaning of the hole and an increase both in the friction coefficients of the pipe string pipes inside the drill hole and in the areas of contact between the pipes and the walls of the hole.

In order to decrease the friction coefficient and the area of contact between the pipe string and the walls of the hole, it has been proposed to use devices comprising a sleeve which may be mounted on the pipe string so that the pipe string can rotate inside the sleeve which itself comes into contact with the wall of the drill hole and which is thus rotationally immobilized. The sleeve constitutes a bearing inside which the pipe string is mounted so as to be able to rotate.

The area of contact between the pipe string and the wall of the hole is limited to the regions of contact of the rotationally immobilized sleeves with the wall of the drill hole, the sleeves having an overall outside diameter greater than the diameter of the pipes of the drill string. Grooves are generally provided on the outside surface of the rotationally immobilized sleeves, which grooves may be of helical shape and allow circulation of the drilling mud in the annular space between the wall of the drill hole and the pipe string. Because of the fact that they are rotationally immobilized, the sleeves do not make it possible to activate the circulation of the drilling fluid entraining the debris produced by the drill bit. The role of the known devices is therefore limited to reducing the friction between the pipes and the drill hole.

Moreover, drill pipes or tubulars are known which include on their external surface grooves of helical shape, these pipes or tubulars being rotationally driven with the pipe string. However, these parts of the drill pipes in the form of an Archimedean screw are not designed to promote the entrainment of the drilling fluid and of the debris suspended in this fluid, but to remedy the risks of differential-pressure sticking in the drill hole.

SUMMARY OF THE INVENTION

The object of the invention is therefore to provide an element of a rotating drill pipe string which includes at least one portion of tubular shape whose external surface has at least one groove arranged in a helix having for an axis the axis of the portion, this pipe string element making it possible to activate the circulation of the fluid and of the drilling debris, to improve the cleaning of the annular space of the drill hole and to reduce the frictional forces between the pipe string and the drill hole.

For this purpose, the groove has a cross-section in a plane perpendicular to the axis of the pipe having an undercut part lying to the rear of a radius of the cross-section of the portion passing through the external end of the section of the groove lying to the rear of the groove, with respect to the direction of rotation of the pipe string, the cross-section of the groove being bounded to the rear of the groove by an approximately straight line making a negative undercut angle with the radius of the cross-section of the portion.

The invention relates in particular to an element of a drill pipe string constituting an intermediate connection between two pipes and including a rotating portion provided with means for connecting the drill pipes, the external surface of which includes a groove with a cross-section having an undercut part.

The invention also relates to an element of a drill pipe string consisting of a drill pipe which has at least two portions along its length having an external surface with a groove whose cross-section includes an undercut part.

In order to make the invention clearly understood, two embodiments of an element of a drill pipe string according to the invention will now be described, by way of non-limiting example, with reference to the figures appended hereto.

DESCRIPTION OF PREFERRED EMBODIMENTS

Figure 1:
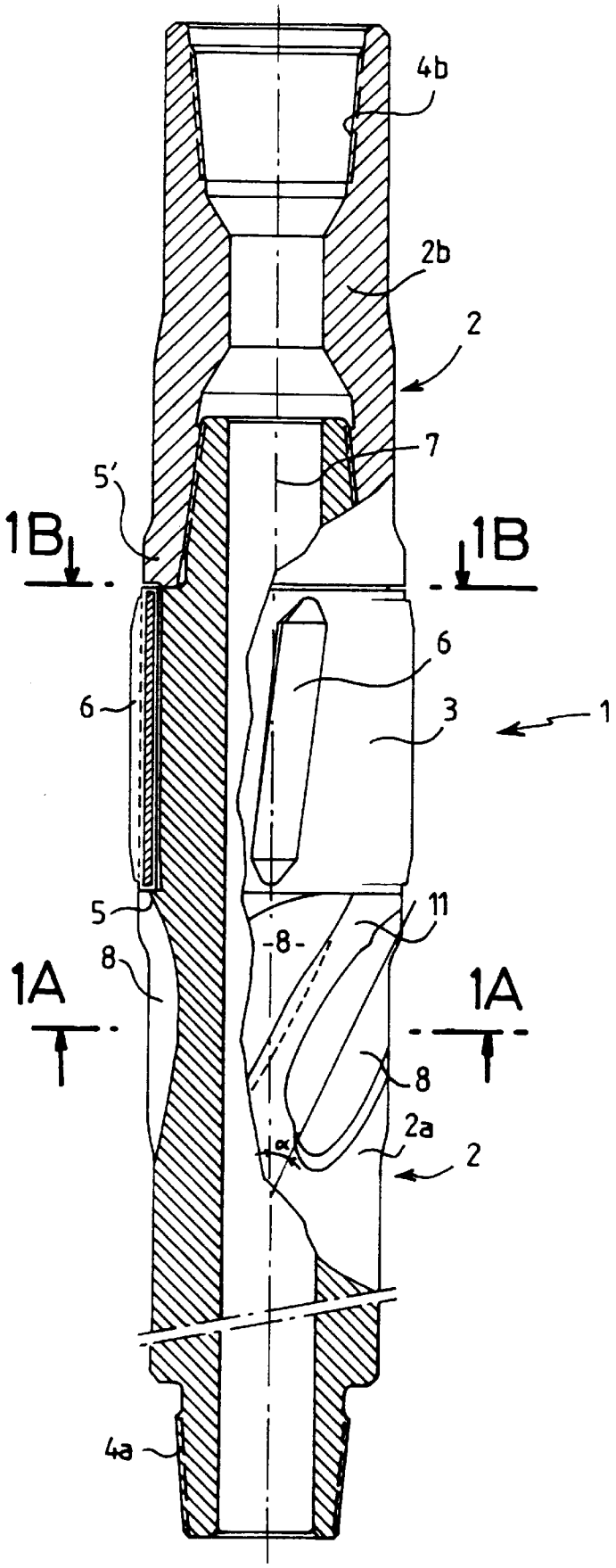
FIG. 1 is an elevation of an element of a drill pipe string according to the invention and according to a first embodiment.
Figure 1A:
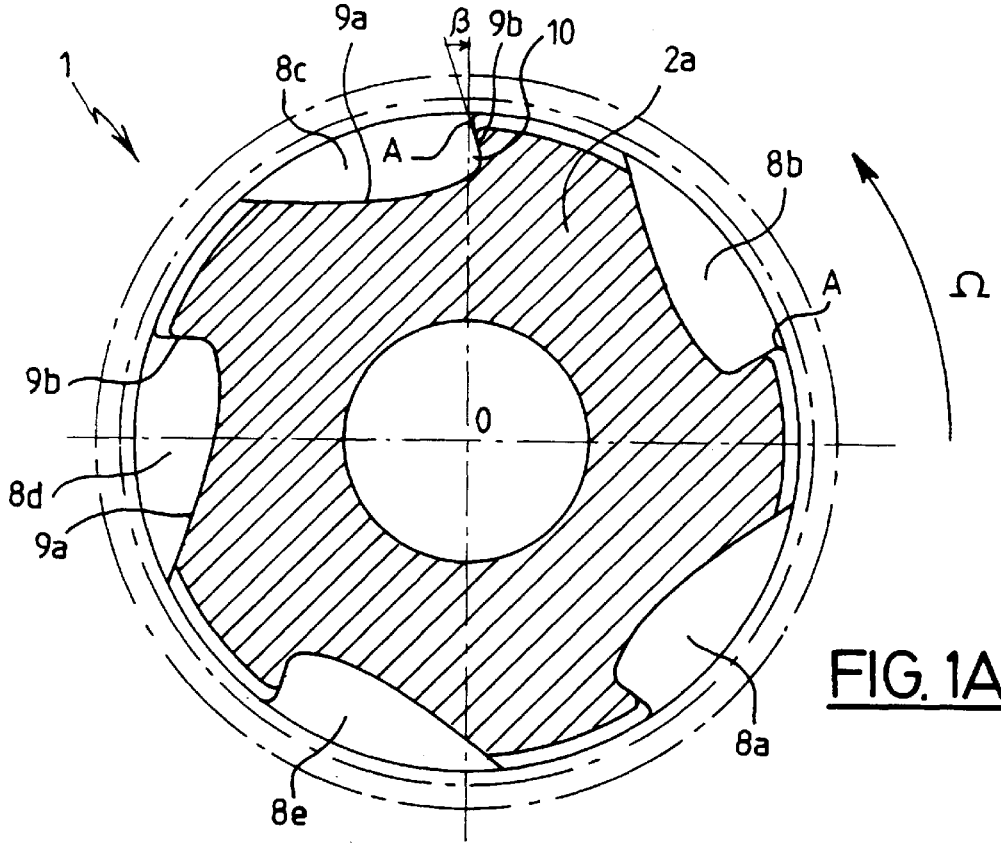
FIG. 1A is a sectional view on A—A of FIG. 1.
Figure 1B:
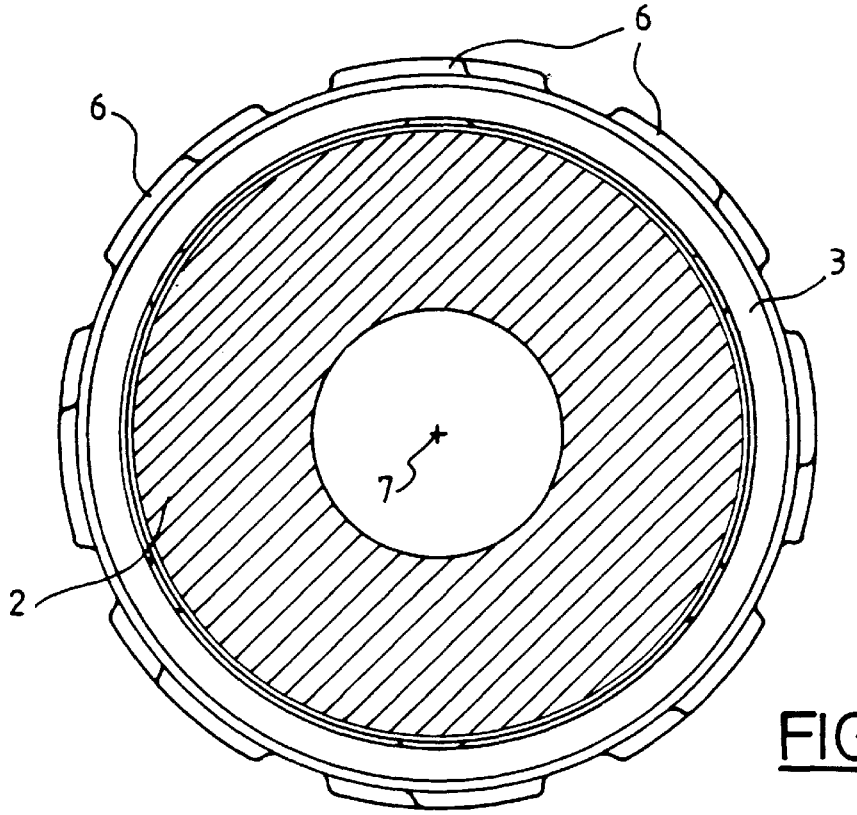
FIG. 1B is a cross-sectional view on B—B of FIG. 1.

The drill pipe string element according to the first embodiment shown in FIGS. 1, 1A and 1B is produced in the form of an intermediate connection between two pipes of a drill pipe string.

The intermediate connection, denoted in a general manner by the reference 1, includes a tubular body 2 consisting of two parts 2*a*, 2*b*, which are fixed in the axial extension of each other by screwing, and a sleeve 3 which is mounted on the body 2 of the connection 1 with a certain radial clearance and is translationally immobilized between the parts 2*a* and 2*b* of the body 2.

The part 2*a* of the body 2 constitutes the lower part of the connection and includes a threaded part 4*a* of frustoconical shape allowing the part 2*a* of the connection 1 to be connected to a pipe string pipe lying on the lower side with respect to the intermediate connection 1, i.e. in the direction of the drill bit fixed on the end of the pipe string.

The part 2*b* of the body 2 constitutes the upper part of the connection and includes a tapped opening 4*b* of frustoconical shape allowing the intermediate connection 1 to be connected to a drill pipe string pipe lying above the intermediate connection 1, i.e. in the direction of the surface from which the drilling takes place. The part 2*a* of the body 2 also includes, at its end opposite the threaded part 4*a*, a second threaded part and the second part 2*b* of the body 2 of the connection 1 includes a second tapped opening at its end opposite the end having the tapped opening 4*b*. The two parts 2*a* and 2*b* of the body 2 of the connection 1 may be joined together by screwing the second threaded end of the part 2*a* inside the second tapped opening of the upper part 2*b* of the body 2.

Before joining the two parts of the body 2, by screwing, the sleeve 3 is engaged on a smooth cylindrical part of the body 2 lying below the second threaded end of the lower part 2*a* of the body 2.

The inside diameter of the sleeve 3 is slightly greater than the outside diameter of the smooth cylindrical part of the lower portion 2*a* of the body 2. In this way, the body 2 of the intermediate connection 1 is mounted so as to rotate freely inside the sleeve 3.

In addition, the sleeve 3 is translationally immobilized axially between the two portions 2*a* and 2*b* of the body 2 because of the fact that the lower portion 2*a* includes, below the smooth cylindrical region, a part 5 which projects radially with respect to the smooth cylindrical part opposite the lower end of the sleeve 3 and because of the fact that the upper portion 2*b* of the body 2 includes, at its lower end, a part 5' which projects radially opposite the upper end of the sleeve 3. After joining the two portions 2*a* and 2*b* of the body 2 of the connection 1 by screwing, the axial distance between the upper end of the part 5 of the portion 2*a* and the lower end of the portion 2*b* is slightly greater than the length in the axial direction of the sleeve 3. The body 2 is then mounted so as to rotate freely inside the sleeve 3 which is itself held around the smooth cylindrical part of the portion 2*a* by the lower part 5' of the portion 2*b*.

When the intermediate connection 1 is fixed between two pipes of the pipe string by means of the threaded part 4*a* of the lower portion 2*a* and by means of the tapped opening 4*b* of the portion 2*b* of the body 2, respectively, the two parts of the pipe string on each side of the intermediate connection 1 are arranged coaxially and have for axis the axis 7 common to the two portions 2*a* and 2*b* lying together in a coaxial arrangement.

On its external surface, the sleeve 3 includes radially projecting blades 6 having a direction which is slightly inclined with respect to the axis 7 of the intermediate connection 1.

The overall outside diameter of the sleeve 3 is substantially greater than the diameter of the end parts of the portions 2*a* and 2*b* of the body 2 of the connection 1 and greater than the diameter of the pipes of the pipe string. The drill bit placed at the end of the lower part of the pipe string produces a drill hole whose diameter is substantially greater than the diameter of the pipes of the pipe string and slightly greater than the overall outside diameter of the sleeve 3. When the pipe string is inside the drill hole, the sleeve 3 is blocked against the wall of the drill hole by means of the blades 6. Consequently, the pipe string can rotate inside the sleeve 3 constituting a bearing for the rotating pipe string.

Preferably, the sleeve 3 is made in composite form and includes a tubular cylindrical metallic part covered with an external jacket which may be made of a wear material or made of rubber and which, on its external surface, includes the inclined and radially projecting blades 6.

The use of the sleeve 3 makes it possible to reduce the friction of the pipe string inside the drill hole because of the fact that the frictional surfaces are limited to the external surfaces of the bearing blades inside the drill hole. Of course, a plurality of intermediate connections are used, each of these being fixed between two pipes of the pipe string or between two tubular string elements.

Such devices do actually make it possible to reduce the friction of the pipe string but do not make it possible to facilitate the circulation of the drilling fluid and the disbandment of the debris torn off by the drill bit in the annular space, i.e. in the space between the surface of the drill hole and the pipe string.

According to the invention, at least part of the body 2 of the intermediate connections of the pipe string and preferably the lower portion 2*a* of the intermediate connections includes profiled grooves 8 arranged in a helix having for axis the axis 7 of the intermediate connection.

As may be seen in FIG. 1A, the lower portion 2*a* of the body 2 of the connection 1 includes, around its periphery, five grooves 8*a*, 8*b*, 8*c*, 8*d* and 8*e* whose cross-sections are identical and are derived from each other by a rotation of 72° about the axis 7 of the portion 2*a*, this axis being represented by the centre O of the section of the portion 2*a* of FIG. 1A.

The cross-sections of the grooves shown in FIG. 1A are unsymmetrical and bounded, within the portion 2*a*, by a curved line 9*a* and by an approximately straight line 9*b* making an acute angle β with a radius OA of the portion 2*a*, the point A lying on the external surface of the portion 2*a* constituting one of the ends of the cross-section of the groove 8.

FIG. 1A also shows, by an arrow, the direction of rotation Ω of the portion 2*a* of the intermediate connection fixed rigidly to the pipe string when the pipe string rotates inside the drill hole.

The part 9*b* of the internal contour of the grooves is directed towards the rear with respect to the radius OA, with respect to the direction of rotation Ω.

The angle β or undercut angle defined by the straight rear part 9*b* of the section of the groove and the radius OA is regarded as negative, the direction of rotation Ω being taken as the positive direction.

Each of the grooves 8 includes a part 10 lying to the rear of the radius OA, when considering the direction of rotation Ω, the point A consisting of the external end of the section of the groove lying to the rear of the section with respect to the direction of rotation Ω.

That part of the grooves 8 having for cross-section the section part 10 lying to the rear of the radius OA constitutes an undercut part of the grooves, i.e. a recessed machined part to the rear of the radii of the sections of the portion 2*a* each joining the centre of a section to an external end of the groove lying to the rear of this groove.

As may be seen in FIG. 1, the grooves make an average angle of inclination α with respect to the axis 7, this being the angle of inclination of the helix followed by the groove 8.

Furthermore, the grooves 8 have a depth which increases between their lower and upper end parts and their central part.

The helical shape of the grooves and the inclination of these grooves with respect to the axis of the body 2 of the intermediate connection 1 to the right in the direction from the bottom up makes it possible to obtain an Archimedean screw effect during rotation of the pipe string. However, as explained above, this Archimedean screw effect itself only produces a very small activation of the drilling fluid entraining the debris upwards in the annular space, during drilling, when the drill pipe rotates in the direction indicated in FIG. 1A.

On the other hand, the fact that the grooves 8 include an undercut part makes it possible to strongly activate the circulation of the drilling fluid and the debris. The undercut part 10 of the grooves 8 has a bailer effect during rotation of the pipe string. The drilling fluid and the debris suspended in the drilling fluid are retained and rotationally entrained by the undercut parts of the grooves so that the fluid and the debris acting in conjunction with the helical grooves inclined at an angle $\alpha$ with respect to the axis of the intermediate connection are entrained upwards. The activation of the circulation upwards of the drilling fluid and of the debris, as well as the agitation produced during the rotation of the profiled part of the body of the tubular connection including the grooves 8, remove the risks of accumulation of debris in the annular space and in particular near the bottom of the hole.

The undercut part of the grooves makes it possible to clean the drill hole by disbanding the debris from the wall of the hole, while the inclination of the grooves with respect to the axis makes it possible to promote the axial entrainment of the drilling fluid and of the debris.

The angles $\alpha$ and $\beta$ may be fixed, for example to a value of between 10 and 80°, it being possible for the values of the angles $\alpha$ and $\beta$ to be chosen in order to optimize the circulation of the debris.

The shape and the depth of the undercut part of the grooves 8 are also chosen in order to optimize the disbandment and upward entrainment of the debris in the annular space of the drill hole.

In the case of the drill pipe string element consisting of an intermediate connection such as just described, the frictional forces of the pipe string inside the drill hole are decreased both because of the use of a sleeve, which makes it possible to limit the area of contact and the friction between the pipe string and the drill hole, and because of the presence of the grooves which make it possible to remove the debris and to avoid accumulation of the debris between the pipe string and the drill hole.

In order to limit the wear of the external surface 11 of the body 2 of the intermediate connection, between the grooves 8, the external surface 11 may be coated with a layer of facing made of a wear-resistant material.

The sleeve 3 mounted so as to rotate on the body 2 may be made of a single part, engaged axially on the smooth cylindrical part of the body 2, and then be translationally immobilized axially when assembling the two parts of the body 2, as just described.

The single-part sleeve may also be axially immobilized between a radially projecting bearing surface machined on part of the body and a ring crimped onto a second part of the body of the intermediate connection.

The sleeve may also be made in several parts and preferably in two parts which may be engaged laterally on the surface of the body of the intermediate connection and then joined together, for example using assembly pins. It is also possible to use a sleeve having two parts joined together by hinges which may be placed in the open position for their engagement on the body of the intermediate connection and then placed in the closed position around the body and joined together, by pins or screws.

It is also possible to replace the sleeve mounted so as to rotate on the body of the intermediate connection with a cylindrical bearing surface machined on the body. The cylindrical bearing surface may include grooves allowing circulation of the fluid in the annular space, in the region of the cylindrical bearing surface.

If an added sleeve is used, which is mounted so as to rotate on the body of the intermediate connection and which may be blocked inside the drill hole, this sleeve may consist of a single piece of steel machined on its external lateral surface in order to have grooves or splines allowing circulation of the coolant and a reduction in the area of bearing on the wall of the drill hole. The sleeve mounted so as to rotate on the body of the intermediate connection may also be in composite form, as already described above. In this case, the sleeve may preferably include a metallic tubular core which is covered with a wear material or which is embedded in an elastomeric sleeve having, on its outside surface, ribs or blades for bearing on the wall of the drill hole.

The sleeve may be mounted so as to rotate on a smooth part of the body of the intermediate connection, so as to form a friction bearing, or else mounted so as to rotate on a part of the body by means of a ball-bearing or a roller bearing.

In all cases, the sleeve or the fixed bearing surface for bearing on the wall of the drill hole has an outside diameter equal to or slightly greater than the maximum diameter of the portion of the body of the intermediate connection in the upper end region of the grooves.

In order to reduce the frictional forces of the drill pipe string inside the drill hole and to activate the circulation of the drilling fluid and of the debris, it is possible to use a plurality of intermediate connections identical to the connection just described, each of these intermediate connections being fixed between two drill pipes of the pipe string.

It is also possible, in order to reduce the frictional forces and to activate the circulation of the drilling fluid, to use one or more drilling pipe string elements according to the invention, each consisting of a drilling rod having a particular structure which will be described below with regard to FIGS. 2, 2A, 2B and 2C.

Figure 2:
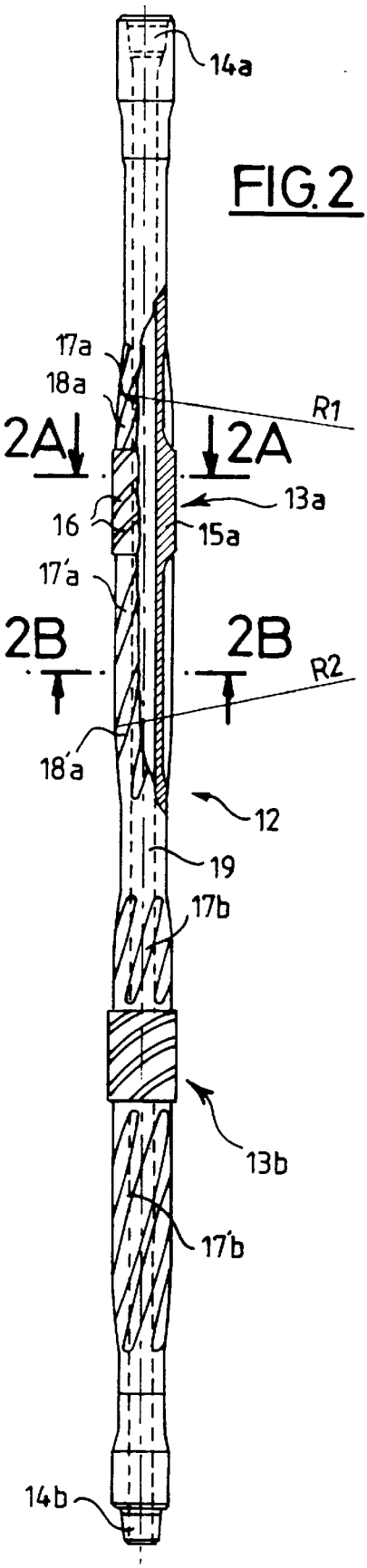
FIG. 2 is an elevation of an element of a drill pipe string according to the invention and according to a second embodiment.

FIG. 2 shows a drill pipe denoted in a general manner by the reference 12 and designed so as to constitute a drill pipe string element according to the invention making it possible to reduce the frictional forces and to activate the circulation of the drilling fluid and of the debris inside the drill hole, when the drill pipe 12 is inserted on a pipe string used for drilling the hole.

The pipe string element according to the invention may consist either of an unsupported drill pipe of the pipe string, or of a heavy pipe, an intermediate pipe or compression pipe.

In all cases, the general structure of the pipe is similar to the structure of the pipe 12 shown in FIG. 2.

The drill pipe 12 has an elongate tubular body which includes, at one of its ends or upper end, a frustoconical tapped opening 14*a* making it possible to connect the rod 12 to a drill pipe string pipe lying above the pipe 12, i.e. towards the surface from which drilling is carried out.

At its end opposite the tapped opening 14*a*,the pipe 12 includes a frustoconical threaded part 14*b* making it possible to join, end to end, the pipe 12 to a pipe of the pipe string lying below the pipe 12, i.e. towards the drill bit.

The pipe 12 constituting a drill pipe string element according to the invention includes, along its length, in approximately equidistant positions with respect to the ends and with respect to the central part of the pipe, two identical bearing assemblies 13*a* and 13*b* making it possible to reduce the frictional forces and to activate the circulation of the drilling fluid in the annular space of the drill hole.

Each of the bearing assemblies 13*a* and 13*b* includes a central region for bearing on the wall of the drill hole and two end parts arranged on each side of the central region, in which end parts the drill pipe is machined so as to have helical grooves.

Only the upper bearing assembly 13*a* will be described below, the assembly 13*b* being identical to the assembly 13*a*.

The bearing assembly 13*a* includes a central region consisting of a bearing surface 15*a*, the cylindrical external surface of which is machined so as to have helical grooves 16.

The bearing surface 15*a* is made as a single piece with the drill pipe by machining the external surface of the drill pipe in the central region.

Figure 2A:
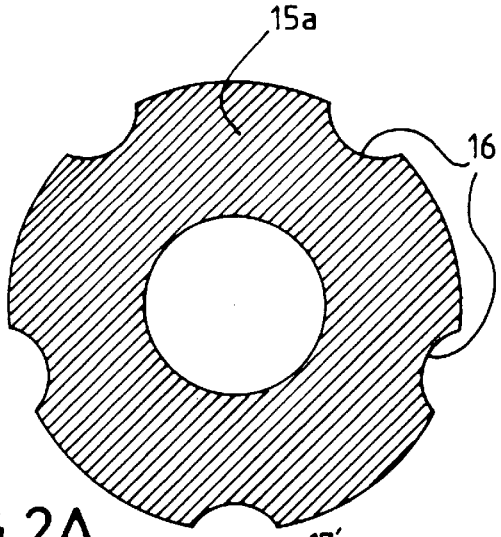
FIG. 2A is a cross-sectional view on A—A of FIG. 2.

The grooves 16 machined in the central region have an approximately constant depth, as may be seen in FIG. 2A, and allow circulation of the drilling fluid in the region of the bearing surface 15*a*.

On each side of the bearing surface 15*a*, the drill pipe is machined so as to form two end parts 17*a* and 17'*a* of the bearing assembly 13*a*, making it possible to activate the circulation of the drilling fluid and of the debris in the annular space.

The parts 17*a* and 17'*a* constitute hydraulic profiles for activating the circulation of the fluid, these being generally similar to the region of the intermediate connection shown in FIG. 1, having grooves 8.

Figure 2B:
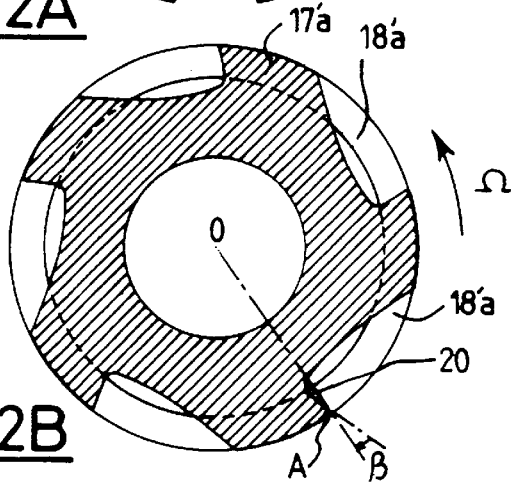
FIG. 2B is a cross-sectional view on B—B of FIG. 2.

As may be seen in FIGS. 2 and 2B, the part 17'*a* of the bearing assembly 13*a* includes a plurality of grooves 18'*a*, the shape of the cross-section of which is similar to the shape of the section of the grooves 8 of the intermediate connection 1 shown in FIG. 1A.

It is therefore not necessary to describe the section of the part 17'*a* of the bearing region 13*a* shown in FIG. 2B, this section being substantially similar to the section of the part 2*a* of the intermediate connection shown in FIG. 1A, in the region including the grooves 8.

In particular, the part 17'*a* of the bearing region 13*a* includes five grooves 18'*a* of helical shape whose general direction makes an angle $\alpha$ with the axis 19 of the pipe 12 and whose cross-section has an undercut part 20, according to the definition given of this term in the case of the intermediate connection 1 shown in FIGS. 1, 1A and 1B.

The section of the grooves 18'*a* is bounded to the rear by an approximately straight line making an acute angle $\beta$, or undercut angle with the radius of the section of the pipe passing through the external end of the section of the groove lying to the rear of the groove, this external end of the groove being on the external surface of the pipe.

The section of the part 17*a* of the bearing region 13*a* is identical to the section of the part 17'*a* and includes helical grooves 18*a*, the section of which is identical to the section of the grooves 18'*a*.

The external surface of the pipe 12, in the end regions 17*a* and 17'*a* of the bearing region 13*a*, is a surface of revolution about the axis 19 of the pipe, at least part of which has a generating curve in the form of a circular arc. The end part 17*a* of the pipe thus includes an external surface of revolution whose generating curves, at least in the region where the part 17*a* joins the unsupported part of the cylindrical pipe 12, consist of circular arcs of radius R1. Likewise, the part 17'*a* of the pipe 12 has an external surface which has the shape of a body of revolution about the axis 19 of the pipe, the generatrices of which, at least in the region where the part 17'*a* joins the central part of the cylindrical pipe, consist of circular arcs of radius R2.

The radii R1 and R2, which may be equal, have a length at least equal to one metre.

The central part of the bearing region 13*a* constituting the bearing surface 15*a* has a cylindrical shape and a diameter slightly greater than the diameter of the ends of the parts 17*a* and 17'*a* of the pipe which join the central part 15*a*. This diameter could also be approximately equal to the diameter of the ends for joining the parts 17*a* and 17'*a*.

It is also possible to machine the bearing surface 15*a* so that its external surface has the shape of a body of revolution and generatrices consisting of circular arcs having a radius R3 which may be equal to the radii R1 and R2 of the circular arcs constituting the generatrices of the external surface of the end parts 17*a* and 17'*a*.

Preferably, the radii R1 and R2 are equal. The radius R3 of the generatrices of the outside surface of the central bearing surface 15*a* may be equal to the radius R1 or R2 or else, as in the embodiment shown in FIG. 2, the external surface may have straight generatrices, i.e. an infinite radius R3.

In general, the outside diameter of the bearing surface 15*a* is at least equal to or greater than the maximum diameter of the parts 17*a* and 17'*a* and constitutes the maximum diameter of the drill pipe. The diameter of the bearing surface 15*a* is itself slightly less than the diameter of the drill hole.

When the pipe string including the pipe 12 rotates inside the drill hole, the bearing surface 15*a* of the bearing assemblies 13*a* makes it possible to reduce the friction between the drill pipe and the wall of the drill hole and the hydraulic profiles of the parts 17*a* and 17'*a* which have just been described make it possible to activate the circulation of the drilling fluid and to disbond the debris. This allows better cleaning in the annular space of the drill hole.

The second bearing assembly 13*b* of the drill pipe 12 fulfils functions identical to the first bearing assembly 13*a*. In particular, this second bearing assembly includes end parts 17*b* and 17'*b* consisting of hydraulic profiles which are identical, respectively, to the parts 17*a* and 17'*a* of the first bearing assembly 13*a*.

The sections of these hydraulic profiles 17*b* and 17'*b* are identical to the section shown in FIG. 2B.

Figure 3:
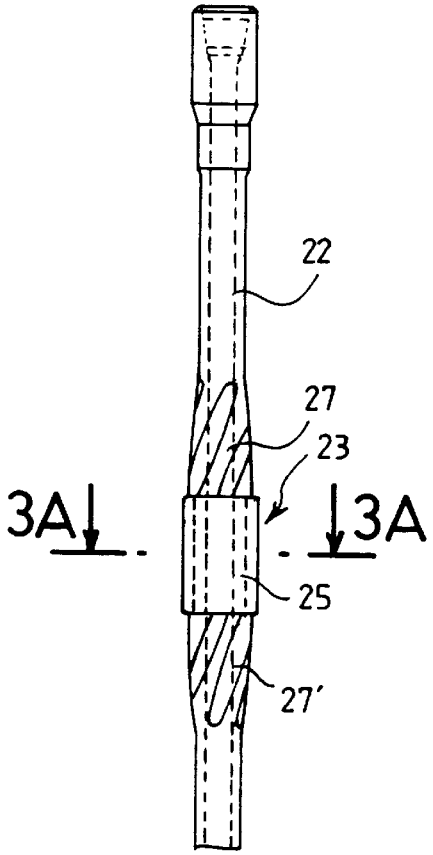
FIG. 3 is a partial elevation of an alternative embodiment of the pipe string element shown in FIG. 2.

FIG. 3 shows part of a drill pipe 22 produced according to a variant of the embodiment shown in FIG. 2. The drill pipe 22 has two identical bearing assemblies, only one of which is shown in FIG. 3.

The bearing assembly 23 includes a central part consisting of a sleeve 25 attached to the pipe 22 which is mounted so as to rotate inside the sleeve 25. On each side of the sleeve 25, the bearing assembly 23 has two parts 27 and 27' which are identical to the parts 17*a* and 17'*a* or 17*b* and 17'*b* of the pipe 12 shown in FIG. 2.

Figure 3A:
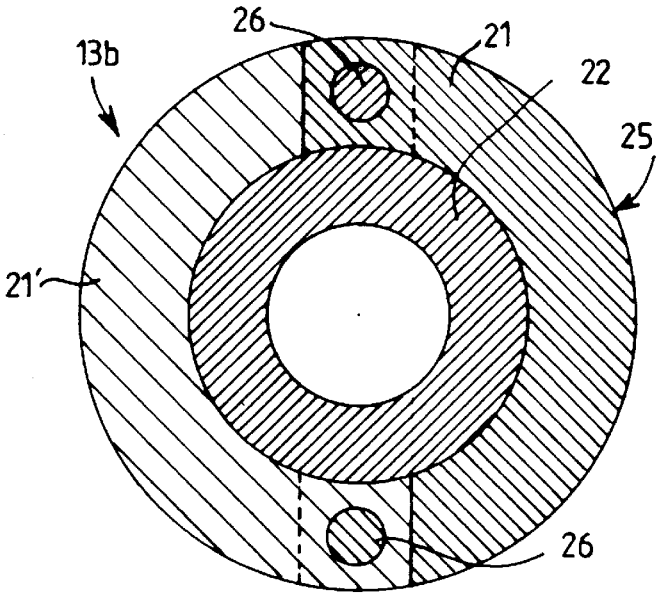
FIG. 3A is a cross-sectional view on A—A of FIG. 3.

As may be seen in FIG. 3A, the sleeve 25 is made in two parts having the shape of two semicylindrical tubular pieces 21 and 21' which may be engaged laterally on part of the pipe 22, the diameter of which is less than the diameter of the parts 27 and 27', and are joined together in the junction regions by pins or cotters 26. The sleeve 25 is thus translationally immobilized axially on the pipe 22.

When the pipe string including the pipe 22 rotates inside the drill hole, the sleeve 25, the diameter of which is greater than the maximum diameter of the drill pipe, bears on the wall of the drill hole and is rotationally immobilized.

The pipe 22 rotates inside the sleeve 25, the latter acting as a plain bearing. Thus, the friction of the pipe string is reduced.

Of course, the sleeve 25 may include, on its external surface, grooves or splines facilitating circulation of the drilling fluid and reducing the area of contact between the pipe string and the wall of the hole.

The sleeve 25 may be produced in a one-piece manner or in a composite manner as described above with regard to the sleeve 3 of the intermediate connection 1 according to the first embodiment of the invention.

When the device according to the invention is produced in the form of a drill pipe, this drill pipe may include a single bearing assembly in the central part of the pipe or else several bearing assemblies distributed along the length of the drill pipe.

Generally, two bearing assemblies are used, these being arranged symmetrically with respect to the centre of the pipe or else three bearing assemblies are used, one of which lies in the central part of the pipe and the other two are arranged at equal distances from the ends of the pipe.

Each of the bearing assemblies may include a sleeve in which the drill pipe is mounted so as to rotate, or else a bearing surface produced as one piece with the drill pipe.

The invention is not limited to the embodiments which have been described.

The grooves machined in the tubular portion or portions constituting hydraulic profiles for activating the circulation of the fluid and the disbandment of the debris may have a shape other than that described. These grooves may have a depth which varies or is substantially constant over their length. The maximum depth of the grooves may be adapted to the activation effect desired.

In all cases, of course, the grooves may have an undercut part, this undercut part occupying a greater or lesser fraction of the cross-section of the groove so as to control the effect of debris disbondment by the hydraulic profile. The negative undercut angle of the section of the grooves may be chosen so as to optimize the effect of drilling fluid entrainment and debris disbondment, taking into account the angle $\alpha$ of inclination of the helical grooves.

The pipe portions constituting hydraulic profiles may have a number of grooves differing from five, for example four grooves at 90° with respect to each other, or three grooves at 120° around the axis of the pipe.

In general, the drill pipe string element according to the invention, having hydraulic profiles for drilling-fluid and debris entrainment may consist of an element different from an intermediate connection or drill pipe, as described by way of examples.

What is claimed is:

1. An element of a drill pipe string which is rotatable in a forward direction, said drill pipe string element comprising at least one tubular portion (2*a*, 17*a*, 17'*a*, 17*b*, 17'*b*, 27, 27') having a generally circular transverse cross-section, a longitudinal axis, and an external surface containing at least one groove (8, 8*a*, 8*b*, 8*c*, 8*d*, 8*e*, 18*a*, 18'*a*) arranged in a helix having as an axis the longitudinal axis (7, 19) of the portion, wherein the groove (8, 8*a*, 18'*a*) has a cross-section which, in a plane perpendicular to the longitudinal axis (7, 19) of the portion (2*a*, 17*a*, 17'*a*, 17*b*, 17'*b*, 27, 27'), has an undercut part (10, 20) lying to the rear, with respect to said forward direction, of a radius (OA) of the generally circular cross-section of the portion (2*a*, 17*a*, 17'*a*, 17*b*, 17'*b*, 27, 27'), said radius passing through an external end (A) of the area of the groove lying to the rear of the groove with respect to the forward direction of rotation ($\Omega$) of the pipe string, and wherein the groove (8, 18*a*, 18'*a*) is bounded to the rear of the groove by an approximately straight line (9*b*) making a rearward undercut angle ($\beta$) with the radius (OA) of the generally circular cross-section of the portion.

2. Drill pipe string element according to claim 1, characterized in that the groove (8, 18*a*, 18'*a*) is inclined at an angle ($\alpha$) with respect to the axis (7, 9) of the portion (2*a*, 17*a*, 17'*a*, 17*b*, 17'*b*, 27, 27').

3. Drill pipe string element according to claim 1, characterized in that the undercut angle ($\beta$) is between 10° and 80°.

4. Drill pipe string element according to claim 1, characterized in that the portion (2*a*, 17*a*, 17'*a*, 17*b*, 17'*b*) includes five grooves (8, 18*a*, 18'*a*), the positions of which along the circumference of the portion are derived from each other by a rotation of 72° about the axis (7, 9) of the portion.

5. The drill pipe string element, according to claim 1, forming, an intermediate connection (1) between first and second drill pipes of the pipe string, includes said intermediate connection comprising:

a tubular body (2) including said at least one tubular portion (2*a*) and said at least o ne groove (8) whose cross-section has an undercut part (10), the tubular body (2) having, at its opposite longitudinal ends, means (4*a*, 4*b*) for joining the body (2) of the intermediate connection (1) to said first and second pipes, respectively, of the pipe string, and a sleeve (3) mounted so as to rotate on part of the body (2) of the intermediate connection (1), adjacent to the tubular portion (2*a*) with the groove (8) having an undercut part (10), said sleeve having an outside diameter at least equal to the diameter of the tubular portion (2*a*) of the body (2) of the intermediate connection (1), in its part adjacent to the sleeve (3).

6. Pipe string element according to claim 5, characterized in that the sleeve (3) is translationally immobilized axially between two portions (2*a*, 2*b*) of the body (2) which are joined together by screwing.

7. Pipe string element according to claim 5, characterized in that the tubular portion (2*a*) of the body (2) of the intermediate connection (1) is coated with a wear-resistant material on a part (11) of its external surface not occupied by the groove (8).

8. Pipe string element according to claim 1, characterized in that it consists of a drill pipe (12, 22) of the pipe string, including at least one bearing region (13*a*, 13*b*, 23) having a central bearing part (15*a*, 15*b*, 25) and two end portions (17*a*, 17'*a*, 17*b*, 17'*b*, 27, 27') on each side of the central bearing region (15*a*, 15*b*, 25) having, on their external surfaces, at least one groove (18*a*, 18'*a*) arranged in a helix and having an undercut part (20).

9. Drill pipe string element according to claim 8, characterized in that the central bearing region (15*a*, 15*b*) of the bearing assembly (13*a*, 13*b*) of the drill pipe (12) consists of a bearing surface produced as one piece with the drill pipe (12) and having an outside diameter constituting the maximum diameter of the drill pipe (12).

10. Drill pipe string element according to claim 8, characterized in that the central bearing region (25) of the bearing assembly (23) of the drill pipe (22) consists of a tubular sleeve (25) attached and fixed against the drill pipe (22) so that the drill pipe (22) can rotate inside the sleeve (25) and so that the sleeve (25) is translationally immobilized axially with respect to the pipe (22).

11. Drill pipe string element according to claim 8, characterized in that the end regions (17*a*, 17'*a*, 17*b*, 17'*b*, 27, 27') of the bearing assemblies (13*a*, 13*b*, 23) of the drill pipe (12, 22) having at least one groove (18*a*, 18*b*), the section of which has an undercut, constitute portions of the pipe (12, 22) whose outside surface has the shape of a body of revolution having generatrices, at least part of which has the shape of a circular arc whose radius is at least equal to one metre.

12. Drill pipe string element according to claim 8, characterized in that the central bearing region (15*a*, 15*b*, 25) of the bearing assemblies (13*a*, 13*b*, 23) of the drill pipe (22) has an external surface which has the shape of a body of revolution, the generatrices of which have the shape of circular arcs whose radius is at least equal to one metre.

13. Drill pipe string element according to claim 8, characterized in that the drill pipe (12, 22) has two bearing assemblies (13*a*, 13*b*, 23) arranged at equal distances from the central part of the pipe (12, 22).

14. Drill pipe string element according to claim 8, characterized in that the drill pipe (12, 22) has three bearing assemblies, one of which lies in the central part of the drill pipe (22) and the other two are arranged at equal distances from the ends of the drill pipe (22).

15. An intermediate element of a drill pipe string which is rotatable in a forward direction about an axis, said intermediate element being connected at an upper axial end thereof to an upper drill string element, situated in the direction of a surface from which drilling takes place, and at a lower axial end thereof to a lower drill string situated in an opposite direction toward a drill bit, said intermediate element being of cylindrical tubular shape and comprising at least one cylindrical bearing surface having: a maximum external diameter along the element; and, at least downwards of the bearing surface, an axisymmetrical portion having an external surface containing at least one groove arranged in a helix wound around the axis of symmetry of said portion;

wherein said groove has an inclination, with respect to the axis of said portion, to provide an Archimedian screw effect during rotation of the drill string and an activation of a drilling fluid in an annular space between the drill pipe string and a hole drilled by the drill bit, thereby upwardly entraining debris contained in the drilling fluid, said axisymmetrical portion of said intermediate element having a generally circular outline, in cross-section in a plane perpendicular to the axis of the axisymmetrical portion, which has a maximum diameter that is, at most, equal to a minimum diameter of the cross-section of said bearing surface, said groove being cut in said axisymmetrical portion, and having: in cross-section, a dissymmetrical shape with, on the circular outline of cross-section of the cylindrical portion, a rear external end with respect to said forward direction; and, rearwardly of a rear radius of the circular outline passing through the rear external end of the groove, an undercut part, and wherein the cross-section of the groove is limited rearwardly by an approximately straight line passing through the rear end of the groove and making with the rear radius a rearward undercut angle oriented from the straight line limiting the groove to the rear radius of the circular outline, said straight line and said rear radius being oriented outwards of the circular outline.

* * * * *